US008300037B2

(12) United States Patent
Suyama

(10) Patent No.: US 8,300,037 B2
(45) Date of Patent: Oct. 30, 2012

(54) LIQUID CRYSTAL DISPLAY DEVICE AND METHOD AND CIRCUIT FOR DRIVING THE SAME

(75) Inventor: Tatsuhiko Suyama, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 310 days.

(21) Appl. No.: 12/452,939

(22) PCT Filed: Apr. 24, 2008

(86) PCT No.: PCT/JP2008/057926

§ 371 (c)(1),
(2), (4) Date: Jan. 29, 2010

(87) PCT Pub. No.: WO2009/016866

PCT Pub. Date: Feb. 5, 2009

(65) Prior Publication Data

US 2010/0134458 A1 Jun. 3, 2010

(30) Foreign Application Priority Data

Aug. 2, 2007 (JP) ..... 2007-202030

(51) Int. Cl.
*G09G 5/00* (2006.01)

(52) U.S. Cl. ..... 345/208; 345/87; 345/94

(58) Field of Classification Search ..... 345/87, 345/94, 208, 209, 211, 213
See application file for complete search history.

(56) References Cited

U.S. PATENT DOCUMENTS

| | | | | |
|---|---|---|---|---|
| 6,795,050 | B1 | 9/2004 | Ino et al. | |
| 7,342,562 | B2 * | 3/2008 | Kawase et al. | 345/87 |
| 7,362,321 | B2 * | 4/2008 | Kumada et al. | 345/209 |
| 2002/0011984 | A1 * | 1/2002 | Shirochi et al. | 345/96 |
| 2003/0222837 | A1 * | 12/2003 | Cho | 345/87 |
| 2005/0140633 | A1 | 6/2005 | Kato | |
| 2006/0071928 | A1 * | 4/2006 | Morita | 345/211 |
| 2009/0167665 | A1 * | 7/2009 | Inoue et al. | 345/94 |
| 2010/0134473 | A1 * | 6/2010 | Matsuda et al. | 345/213 |

FOREIGN PATENT DOCUMENTS

| | | |
|---|---|---|
| JP | 08-314411 | 11/1996 |
| JP | 09-106267 | 4/1997 |
| JP | 2000-075841 | 3/2000 |
| JP | 2005-141169 | 6/2005 |
| JP | 2005-156633 | 6/2005 |
| JP | 2006-106398 | 4/2006 |
| JP | 2007-156336 | 6/2007 |

OTHER PUBLICATIONS

English Version of ISR.

* cited by examiner

*Primary Examiner* — Amare Mengistu
*Assistant Examiner* — Premal Patel
(74) *Attorney, Agent, or Firm* — Harness, Dickey & Pierce

(57) ABSTRACT

A liquid crystal display device includes a plurality of data signal lines and scanning signal lines intersecting orthogonally with the data signal lines; pixel electrodes each provided at each of intersections of the plurality of data signal lines and scanning signal lines; and a counter electrode, the plurality of data signal lines are divided into sets each including data signal lines that are provided next to one another so as to respectively correspond to primary colors constituting a display color, the data signal lines in each set being connected to one of output signal lines to which data signals corresponding to the primary colors are supplied during a single horizontal scanning period by time division, the data signals supplied to the output signal lines being switched, the counter electrode being subjected to application of a voltage being varied during at least one horizontal scanning period.

6 Claims, 13 Drawing Sheets

PRIOR ART

LIQUID CRYSTAL DISPLAY DEVICE AND METHOD AND CIRCUIT FOR DRIVING THE SAME

TECHNICAL FIELD

The present invention relates to a liquid crystal display device, and to a method and a circuit for driving the liquid crystal display device. In particular, the present invention relates to a liquid crystal display device in which a plurality of data lines for supplying video signals are bundled into sets each connected to an output of a data line driving circuit and the video signals are outputted by time division, and to a method and a circuit for driving the liquid crystal display device.

BACKGROUND ART

Conventionally, a method called source shared driving (SSD) has been used as one method for driving liquid crystal display devices. A liquid crystal display device includes: a plurality of scanning signal lines; a plurality of data signal lines extending orthogonally to the plurality of scanning signal lines; and pixels provided two-dimensionally at intersections of the above signal lines in a matrix pattern. According to the SSD method, each set of data signal lines is driven by using source signals time-divided by a data output circuit shared by the set of data signal lines.

FIG. 10 is an equivalent circuit diagram illustrating an arrangement of a conventional active matrix liquid crystal display device driven by the SSD method. As illustrated in FIG. 10, the conventional liquid crystal display device includes: a data line driving circuit (source driver) 101; a gate line driving circuit (scanning signal line driving circuit) 102; a data line selection circuit 103; and a display section 109.

The display section 109 includes a plurality of gate lines (m gate lines) GL1 through GLm as scanning signal lines; a plurality of data signal lines (n data signal lines) (source lines) DL1 through DLn intersecting orthogonally with the plurality of gate lines; and a plurality of pixel forming sections (m×n pixel forming sections) each including a pixel switching element 105 and a liquid crystal capacitor 106. The pixel forming sections are provided at respective intersections of the plurality of gate lines GL1 through GLm and the plurality of data signal lines DL1 through DLn. The pixel forming sections are arranged in a matrix pattern so as to form a pixel array.

In each of the pixel forming sections, the pixel switching element 105 has (i) a gate terminal connected to one of the plurality of gate lines, (ii) a source terminal connected to one of the plurality of data signal lines, and (iii) a drain terminal connected to a pixel electrode. Each of the pixel forming sections further includes a counter electrode that is common to all the pixel forming sections and facing each pixel electrode. Each of the pixel electrodes and the counter electrode sandwich a liquid crystal layer, so that a liquid crystal capacitor 106 serving as a pixel capacitor is formed.

Each pixel electrode is supplied with a potential corresponding to an image to be displayed, by means of respective operations of the data line driving circuit 101 and the gate line driving circuit 102, whereas the common electrode is supplied with a predetermined potential from a counter electrode control section 108 (not shown). This voltage application controls an amount of light transmitted through the liquid crystal layer, thereby causing an image display to be carried out. For controlling the amount of transmitted light by applying voltages to the liquid crystal layer, the display section further employs polarizing plates (not shown).

In the active matrix liquid crystal display device driven by the SSD method (see FIG. 10), the plurality of data signal lines DL1 through DLn are connected to their respective gate switching elements 104 and then, every three data signal lines out of the plurality of data signal lines DL1 through DLn are bundled into a set. The set of three data signal lines is further connected to one of output signal lines D1 through Dn/3 of the data line driving circuit 101.

Each of the gate switching elements 104 is connected to the data line selection circuit 103 via one of data line selection lines GLa, GLb, or GLc. The data line selection circuit 103 controls an ON/OFF state of each of the gate switching elements 104. This causes every three data lines forming a set to be sequentially connected to a corresponding one of the output signal lines. For example, the data signal lines DL1, DL2, and DL3 form a set and are connected to the output signal line D1. The control of the ON/OFF state of each corresponding gate switching element 104 by the data line selection circuit 103 causes the data signal lines DL1, DL2, and DL3 to be sequentially and electrically connected to the output signal line D1.

The above is described in more detail below. The data signal lines DL1, DL2, and DL3 are connected to their respective columns of pixels, each of which columns corresponds to one of three primary colors, i.e., red (R), green (G), and blue (B), constituting a display color. Each set of such three data signal lines corresponding to R, G, and B constituting a single display color is driven by a corresponding data output circuit (not shown) which is provided in the data signal line driving circuit 101 and which is common to the set of the data signal lines corresponding to R, G, and B. Each data output circuit supplies data to a corresponding set of data signal lines in the order of R, G, and B. For the purpose of not only increasing a drive rate but also securing a certain time period necessary for each data signal line to write a data signal to corresponding pixels, data signal lines that are in the respective sets and correspond to one color are driven simultaneously. Specifically, among all the data signal lines in the respective sets connected to the output signal lines D1 through Dn/3, data signal lines corresponding to R are first driven simultaneously; data signal lines corresponding to G are next driven simultaneously; and data signal lines corresponding to B are finally driven simultaneously.

In a case where the liquid crystal display device is driven by the above method, the counter electrode 107 is supplied with a voltage at a constant value while one gate line is active. In order to prevent image burning in liquid crystals, a signal (hereinafter referred to as "a COM signal") for driving the counter electrode 107 normally has two potentials alternately outputted. In other words, an inversion driving is normally carried out. Specifically, the counter electrode 107 is supplied with a voltage while a given gate line is active, whereas the counter electrode 107 is supplied with an inversed voltage of the above voltage while another gate line adjacent to the above given gate line is active.

FIG. 11 is a timing chart illustrating the inversion driving of the counter electrode in the liquid crystal display device driven by the SSD method. As illustrated in FIG. 11, the gate lines GL1 through Gm are sequentially supplied with scanning signals. Specifically, the gate lines GL1, GL2, . . . Gm are sequentially selected by the gate line driving circuit 102, and are thereby supplied with scanning signals from the gate line driving circuit 102. This causes each pixel switching element 105 connected to a selected gate line to have a gate turned ON. This causes each of the pixel switching elements 105 to be in an active state in which a source signal (i.e., data signal) can be supplied to a corresponding pixel electrode.

Further, as illustrated in FIG. 11, while each of the gate lines GL1 through Gm is selected, the data line selection lines GLa, GLb, and GLc are sequentially supplied with data line selection signals. The data line selection line GLa is connected to data lines corresponding to R pixels; the data line selection line GLb is connected to data lines corresponding to G pixels; and the data line selection line GLc is connected to data lines corresponding to B pixels. Thus, a sequential supply of data line selection signals to the data line selection lines GLa, GLb, and GLc causes the respective data lines, each of which is connected to pixels corresponding to one of R, G, and B, to be sequentially selected.

For example, in FIG. 11, while the gate line GL1 is selected, the data line selection lines GLa, GLb, and GLc are sequentially supplied with data line selection signals. When a data line selection signal is supplied to a given data line selection line, each gate switching element connected to the given data line selection line is caused to have a gate turned ON. This allows a data signal from a corresponding output signal line to be supplied to each data line connected to such a switching element that is in an ON state. This consequently causes data signals from respective output signal lines to be sequentially supplied to corresponding data lines for respective columns of pixels each of which columns corresponds to one of R, G, and B.

Further, as illustrated in FIG. 11, while each of the gate lines GL1 through Gm is selected, the output signal lines D1 through Dn/3 are supplied with data signals simultaneously. Each output signal line is supplied with data signals for R, G, and B by time division. For example, in FIG. 11, while the gate line GL1 is selected, the output signal line D1 is supplied with data signals R11, G12, and B13 by time division; the output signal line D2 is supplied with data signals R14, G15, and B16 by time division; and the output signal line Dn/3 is supplied with data signals R1($n$−2), G1($n$−1), and B1$n$ by time division.

Each of the output signal lines D1 through Dn/3 is supplied with data signals for R, G, and B by time division at timings synchronizing with respective timings at which the data lines for the respective columns of pixels, each of which columns corresponds to one of R, G, and B, are sequentially selected by the above data line selection signals.

For example, in FIG. 11, while the gate line GL1 is selected, the data line selection lines GLa, GLb, and GLc are sequentially supplied with data line selection signals. The data line selection lines GLa, GLb, and GLc are supplied with the data line selection signals at respective timings each of which synchronizes with a corresponding one of timings at which each of the output signal lines D1 through Dn/3 is sequentially supplied with data signals for R, G, and B by time division.

This makes it possible to supply (i) a data signal for R to each data line for pixels corresponding to R, (ii) a data signal for G to each data line for pixels corresponding to G, and (iii) a data signal for B to each data line for pixels corresponding to B.

As described above, in the case where the liquid crystal display device is driven by the above method, the counter electrode 107 is supplied with a COM signal at a constant value while one gate line is active. In order to prevent image burning in liquid crystals, such a COM signal for driving the counter electrode 107 normally has two potentials alternately outputted. In other words, an inversion driving is normally carried out.

Data signals for R, G, and B are written to pixels as described below.

First, in a period in which the gate line GL1 and the data line selection line GLa are both active, respective voltage differences are produced between (i) the data signals R11 through R1($n$−2) supplied to corresponding data signal lines each connected to one of the output signal lines D1 through Dn/3 and (ii) a COM signal supplied during this period. These voltage differences are respectively written to corresponding pixels (i.e., pixels corresponding to R).

Then, in a period in which the gate line GL1 and the data line selection line GLb are both active, respective voltage differences are produced between (i) the data signals G12 through G1($n$−1) supplied to corresponding data signal lines each connected to one of the output signal lines D1 through Dn/3 and (ii) a COM signal supplied during this period. These voltage differences are respectively written to corresponding pixels (i.e., pixels corresponding to G).

Further, in a period in which the gate line GL1 and the data line selection line GLc are both active, respective voltage differences are produced between (i) the data signals B13 through B1$n$ supplied to corresponding data signal lines each connected to one of the output signal lines D1 through Dn/3 and (ii) a COM signal supplied during this period. These voltage differences are respectively written to corresponding pixels (i.e., pixels corresponding to B).

The above operation causes data signals to be written to all pixels connected to a single gate line. When this writing of data signals to the pixels connected to the gate line GL1 is completed, writing of data signals to pixels connected to the gate line GL2 begins. As in the gate line GL1, the data signals, when written to the pixels connected to the gate line GL2, are sequentially written to respective sets of pixels, each of which sets corresponds to one of R, G, and B. This operation is repeated so that the remaining gate lines are also scanned in the same manner one after another in a vertical direction, until the above operation is carried out with respect to the gate line GLM. As a result, the data signals are written to the M×n pixels constituting an entire screen.

The following description deals with the line inversion driving of the COM signal. FIG. 12 is a circuit diagram illustrating a circuit for generating voltages to be applied to the counter electrode for the line inversion driving. In the line inversion driving, two potentials are alternately outputted. In the example illustrated in FIG. 12, two voltages constituting the COM signal used for the line inversion driving have a high value COMH and a low value COML.

As illustrated in FIG. 12, an inversion driving circuit 120 includes: two selectors 121$a$ and 121$b$; an output buffer 122; and a resistor 123. The resistor 123 is connected to a power supply voltage and also to ground. Each of the selectors 121$a$ and 121$b$ is connected to the resistor 123 via a plurality of terminals, and thereby selects, from among a plurality of voltage values, a value of a voltage to be outputted. The selector 121$a$ outputs a voltage having a selected value as COMH, whereas the selector 121$b$ outputs a voltage having a selected value as COML. The voltages COMH and COML are supplied from the selectors 121$a$ and 121$b$, respectively, to the output buffer 122. The output buffer 122 is also supplied with rectangular waves (e.g., signals each generated for a single horizontal scanning period of a gate line) in synchronization with the line inversion driving. The output buffer 122 alternately outputs COMH and COML as a COM signal in accordance with the rectangular waves supplied. This consequently causes the output buffer to alternately output COMH and COML each for each one line.

Presently, liquid crystal display devices come to have a higher quality level and there arises a growing demand for varying each of respective luminances of R, G, and B independently of the others. In view of such a demand, there have been known methods for independently controlling each of source potentials for R, G, and B.

FIG. 13 is a circuit diagram illustrating a conventional technique of independently adjusting each of source voltages for R, G, and B. In an arrangement where each of luminances of R, G, and B is not independently varied, it is required merely to select each source voltage with use of 8-bit data for displaying 256 levels of gray. Meanwhile, for displaying 256 levels of gray by independently varying each of the luminances of R, G, and B, it is required to independently select and control each of 256 levels of gray for R, 256 levels of gray for G, and 256 levels of gray for B. This requires, as illustrated in FIG. 13, an arrangement in which each source voltage is selected with use of 10-bit data.

Patent Literature 1 discloses a technique of equalizing, in consideration of luminosity, respective brightnesses of R, G, and B in a liquid crystal display device including common signal lines for respective pixel columns for R, G, and B. According to the liquid crystal display device disclosed in Patent Literature 1, common signals supplied to the respective pixel columns for R, G, and B have their respective selected-level voltages that are different from one another. In other words, different selected-level voltages are set in advance for R, G, and B, respectively, so that in a case where respective tones of R, G, and B are identical to one another, an identical brightness is visually sensed for all of R, G, and B by a viewer.

CITATION LIST

Patent Literature 1

Japanese Patent Application Publication, Tokukaihei, No. 8-314411 A (Publication Date: Nov. 29, 1996)

SUMMARY OF INVENTION

Unfortunately, the above arrangement of the conventional technique for independently adjusting each of source voltages for R, G, and B problematically complicates a circuit topology and increases a size of the circuit, as illustrated in FIG. 13. Further, the technique disclosed in Patent Literature 1 requires respective common signal lines for R, G, and B. This indicates that the arrangement disclosed in Patent Literature 1 is based on a technique for simple matrix driving. In contrast, the above active matrix liquid crystal display device driven by the SSD method includes a single common signal line. Thus, although the counter electrode is supplied with a common signal for the line inversion driving, it is impossible to independently adjust each of the luminances of R, G, and B by use of the technique of Patent Literature 1. In addition, driving an active matrix display device including a common signal line for each of R, G, and B would require three counter electrodes that respectively correspond to the three common signal lines. This in turn requires more constituent components, and is therefore impractical.

The present invention has been accomplished in view of the above problem. An object of the present invention is to provide a liquid crystal display device which is an active matrix liquid crystal display device that (i) is driven by the SSD method, (ii) includes data signal lines which is for supplying video signals and every two or more of which data signal lines are bundled and connected to an output of a data line driving circuit, and (iii) is capable of independently adjusting each of luminances of R, G, and B, and a method and a circuit for driving the liquid crystal display device.

A liquid crystal display device of the present invention includes: a plurality of data signal lines; a plurality of scanning signal lines intersecting orthogonally with the plurality of data signal lines; pixel electrodes each provided at each of intersections of the plurality of data signal lines and the plurality of scanning signal lines; and a counter electrode provided so as to face the pixel electrodes, the plurality of data signal lines divided into sets each including data signal lines that are provided next to one another so as to respectively correspond to primary colors constituting a display color, the sets each being connected to a data signal output line to which data signals each corresponding to one of the primary colors are supplied during a single horizontal scanning period by time division, the plurality of data signal lines, each corresponding to one of the primary colors, being sequentially selected so that data signal lines corresponding to one of the primary colors are selected at a time by a data line selection signal supplied in synchronization with a timing at which the data signals supplied to the data signal output line are switched, the counter electrode being subjected to application of a voltage being variable during at least one horizontal scanning period.

According to the above arrangement, the liquid crystal display device of the present invention includes a plurality of data signal lines divided into sets each including data signal lines that are provided next to one another so as to respectively correspond to the primary colors constituting a display color, the sets each being connected to a data signal output line. In a case where, for example, the display color is constituted by R, G, and B, each set includes three data signal lines which are provided next to one another and to which respective data signals corresponding to R, G, and B are supplied. Further, each set of three data signal lines is connected to a single data signal output line. Each data signal output line is supplied with the respective data signals corresponding to R, G, and B during a single horizontal period by time division.

Further, according to the above arrangement, the data signal lines respectively corresponding to the primary colors are sequentially selected, in synchronization with timings at which the data signals supplied to the data signal output line are switched. The data signal lines are selected by data line selection signals. For example, when a data signal supplied to each data signal output line corresponds to R, data signal lines corresponding to R are selected; when a data signal supplied to each data signal output line corresponds to G, data signal lines corresponding to G are selected; and when a data signal supplied to each data signal output line corresponds to B, data signal lines corresponding to B are selected.

In other words, according to the liquid crystal display device of the present invention, the respective data signals corresponding to R, G, and B are sequentially supplied to respectively corresponding pixel electrodes for each horizontal scanning period.

According to the above arrangement, the voltage applied to the counter electrode is variable during at least one horizontal scanning period. In other words, the liquid crystal display device of the present invention is capable of varying the voltage applied to the counter electrode during at least one horizontal scanning period.

For example, in the case where the display color is constituted by R, G, and B, the above arrangement allows the following voltages to be different from one another: a voltage applied to the counter electrode when data signals for R are being supplied to pixel electrodes for R; a voltage applied to the counter electrode when data signals for G is being supplied to pixel electrodes for G; and a voltage applied to the counter electrode when data signals for B is being supplied to pixel electrodes for B.

The voltage applied to the counter electrode may be varied for every horizontal scanning period, or for every other horizontal scanning period (i.e., for every other gate line). The manner in which the voltage applied to the counter electrode is varied among horizontal scanning periods is not particularly limited.

A liquid crystal display device includes pixel electrodes and a counter electrode. Each of the pixel electrodes and the counter electrode form a liquid crystal capacitor. For each pixel, a difference between a voltage applied to a pixel electrode and a voltage applied to the counter electrode is written to a corresponding liquid crystal capacitor as image data. The voltage applied to the counter electrode has conventionally maintained at a constant value during a single horizontal scanning period. Thus, in a case where, for example, R, G, and B have an identical tone, i.e., where respective voltages applied to pixel electrodes each corresponding to one of R, G, and B have an identical value, respective differences between the voltages applied to the pixel electrodes and the voltage applied to the counter electrode are equal to one another. This precludes such a conventional liquid crystal display device from meeting a demand that, for example, a luminance of blue be independently changed even in the case where R, G, and B have an identical tone, in consideration of influence of respective colors of a backlight and a color filter.

In contrast, the liquid crystal display device of the present invention makes it possible to differentiate (i) a voltage applied to the counter electrode when a data signal for R is being supplied to each pixel electrode for R, (ii) a voltage applied to the counter electrode when a data signal for G is being supplied to each pixel electrode for G, and (iii) a voltage applied to the counter electrode when a data signal for B is being supplied to each pixel electrode for B. This makes it possible to independently adjust the respective luminances of the primary colors (e.g., R, G, and B) constituting the display color.

Note (i) that the voltage applied to the counter electrode is not necessarily constant during each of (a) the period during which the data signal for R is being supplied, (b) the period during which the data signal for G is being supplied, and (c) the period during which the data signal for B is being supplied, and (ii) that the voltage waveform is not particularly limited and may thus be any voltage waveform, provided that the voltage waveform allows an effective voltage to be applied for each of R, G, and B so that a desired luminance for each of R, G, and B is achieved.

A method of the present invention for driving a liquid crystal display device is a method for driving a liquid crystal display device, the liquid crystal display device including: a plurality of data signal lines; a plurality of scanning signal lines intersecting orthogonally with the plurality of data signal lines; pixel electrodes each provided at each of intersections of the plurality of data signal lines and the plurality of scanning signal lines; and a counter electrode provided so as to face the pixel electrodes, the plurality of data signal lines divided into sets each including data signal lines that are provided next to one another so as to respectively correspond to primary colors constituting a display color, the data signal lines in each of the sets being sequentially selected during a single horizontal scanning period, the method including the step of: varying a voltage applied to the counter electrode during the single horizontal scanning period.

The above arrangement also achieves the operational advantages of the liquid crystal display device of the present invention.

The liquid crystal display device of the present invention may preferably be arranged so that the voltage applied to the counter electrode is varied in synchronization with the timing.

The above arrangement causes the voltage applied to the counter electrode to be varied in synchronization with the timings at which the data signals supplied to each data signal output line are switched. In a case where, for example, each data signal output line is sequentially supplied with respective data signals for R, G, and B, the voltage applied to the counter electrode is varied in synchronization with timings at which the data signals for R, G, and B thus supplied are switched.

This allows the voltage applied to the counter electrode to be varied for each of R, G, and B, and thus makes it possible to independently adjust the respective luminances of R, G, and B.

Note that the voltage applied to the counter electrode may be varied for each horizontal scanning period so as to correspond to R, G, and B and a manner in which the voltage is varied is not particularly limited.

The liquid crystal display device of the present invention may preferably be arranged so that the voltage applied to the counter electrode is varied by using the data line selection signal.

The above arrangement makes it possible to vary the voltage applied to the counter electrode during a single horizontal period, by using data line selection signals which are supplied to select data signal lines.

This makes it possible to vary the voltage applied to the counter electrode during a single horizontal period, by using the data line selection signals supplied in the liquid crystal display device driven by the SSD method. This in turn makes it possible to independently adjust the respective luminances of R, G, and B with use of a simple arrangement including an additional small circuit.

The liquid crystal display device of the present invention may preferably be arranged so that, in a case where the primary colors corresponding to selected ones of the plurality of data signal lines are same for different horizontal scanning periods, the voltage applied to the counter electrode is identical.

According to the above arrangement, for different horizontal scanning periods, the voltage applied to the counter electrode uniquely corresponds to each of the primary colors constituting the display color.

This allows the voltage applied to the counter electrode to be controlled uniformly in a case where data signal lines of one color are selected for different horizontal scanning periods. This in turn facilitates independent adjustment of the respective luminances of R, G, and B.

The liquid crystal display device of the present invention may preferably be arranged so that the voltage applied to the counter electrode has polarities reversed from each other; and, in a case where the primary colors corresponding to selected ones of the plurality of data signal lines are same for horizontal scanning periods corresponding to an identical polarity, the voltage applied to the counter electrode is identical.

The above arrangement causes a positive voltage and a negative voltage to be alternately applied to the counter electrode. For every horizontal scanning period corresponding to either the positive voltage or the negative voltage, the voltage applied to the counter electrode uniquely corresponds to each of the primary colors constituting the display color.

In the liquid crystal display device having an arrangement in which polarities of the voltage applied to the counter electrode are reversed, the above arrangement allows the voltage applied to the counter electrode to be controlled uniformly in a case where data signal lines of one color are selected for horizontal scanning periods corresponding to one polarity. This in turn facilitates independently adjusting the respective luminances of R, G, and B, and also prevents image burning in liquid crystals.

The liquid crystal display device of the present invention may preferably be arranged so that, in a case where the primary colors corresponding to the selected ones of the plurality of data signal lines are same between any two horizontal scanning periods corresponding to the polarities different from each other, an absolute value of a difference between a center voltage and a positive voltage applied to the counter electrode is equal to an absolute value of a difference between the center voltage and a negative voltage applied to the counter electrode.

A circuit of the present invention is a circuit for driving a liquid crystal display device, the liquid crystal display device including: a plurality of data signal lines; a plurality of scanning signal lines intersecting orthogonally with the plurality of data signal lines; pixel electrodes each provided at each of intersections of the plurality of data signal lines and the plurality of scanning signal lines; and a counter electrode provided so as to face the pixel electrodes, the plurality of data signal lines divided into sets each including data signal lines that are provided next to one another so as to respectively correspond to primary colors constituting a display color, the sets each being connected to a data signal output line to which data signals each corresponding to one of the primary colors are supplied during a single horizontal scanning period by time division, the plurality of data signal lines, each corresponding to one of the primary colors, being sequentially selected so that data signal lines corresponding to one of the primary colors are selected at a time by a data line selection signal supplied in synchronization with a timing at which the data signals supplied to the data signal output line are switched, the circuit varying a voltage applied to the counter electrode during at least one horizontal scanning period, in synchronization with the timing, the circuit varying the voltage in response to the data line selection signal.

According to the above arrangement, the driving circuit is capable of varying the voltage applied to the counter electrode during a single horizontal scanning period, in synchronization with timings at which respective data signals corresponding to the primary colors constituting the display color are sequentially supplied.

This makes it possible to independently adjust the respective luminances of the primary colors (e.g., R, G, and B) constituting the display color.

Additional objects, features, and strengths of the present invention will be made clear by the description below. Further, the advantages of the present invention will be evident from the following explanation in reference to the drawings.

REFERENCE SIGNS LIST

Figure 1:
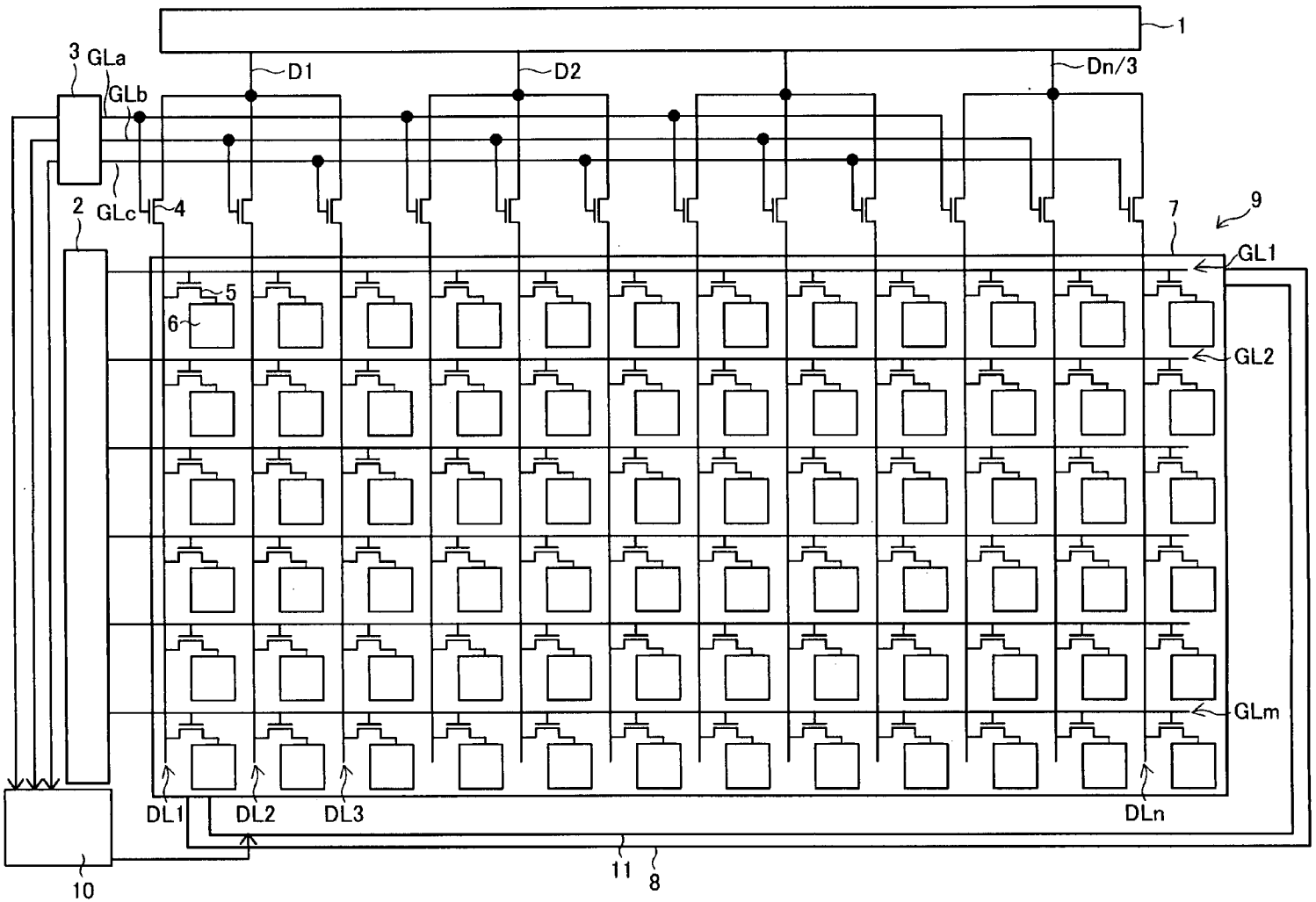
FIG. 1 is a block diagram illustrating a liquid crystal display device of the present invention, together with an equivalent circuit of a display section included in the liquid crystal display device.

1 data line driving circuit
2 gate line driving circuit
3 data line selection circuit
4 gate switching element
5 pixel switching element
6 pixel electrode
7 matrix substrate
8 counter substrate
9 display section
10 counter electrode control section
11 counter electrode
GL1 through GLm gate lines (scanning signal lines)
DL1 through DLn data signal lines
GLa data line selection line
GLb data line selection line
GLc data line selection line
D1 through Dn/3 output signal lines (data signal output lines)

DESCRIPTION OF EMBODIMENTS

Embodiment 1

Arrangement of Liquid Crystal Display Device

A liquid crystal display device according to one embodiment of the present invention is described below with reference to the drawings.

FIG. 1 is a block diagram illustrating the liquid crystal display device of the present embodiment. FIG. 1 also illustrates an equivalent circuit of a display section included in the liquid crystal display device. This liquid crystal display device is an active matrix liquid crystal display device which is driven by a SSD method and which includes data signal lines for supplying video signals. Every two or more of these data signal lines are bundled and connected to an output of a data line driving circuit.

As illustrated in FIG. 1, the liquid crystal display device includes: a data line driving circuit 1; a gate line driving circuit 2; a data line selection circuit 3; a display section 9; and a counter electrode control section 10. The display section 9 includes: two transparent substrates, namely a matrix substrate 7 and a counter substrate 8; and liquid crystal filling a gap between the matrix substrate 7 and the counter substrate. The matrix substrate 7 is provided with: data signal lines DL1 through DLn; gate lines (scanning signal lines) GL1 through GLm; gate switching elements 4; pixel switching elements 5; and pixel electrodes 6. The counter substrate 8 is provided with a counter electrode 11.

On the matrix substrate 7, the data signal lines DL1 through DLn intersect orthogonally with the gate lines GL1 through GLm, so that a display region is segmented in a matrix pattern. Each of regions formed as a result of this segmentation corresponds to a pixel which is a unit of image display. One of the pixel switching elements 5 and one of the pixel electrodes 6 are provided at each of intersections of the data signal lines and the gate lines. Each pixel electrode 6 and the counter electrode 11 provided on the counter substrate 8 form a liquid crystal capacitor for a corresponding pixel. The liquid crystal is filled and sealed between the pixel electrode 6 and the counter electrode 11. An effect of electrolysis between these electrodes changes an alignment of individual liquid crystals, thereby causing light to be transmitted or blocked. The transmission and blocking of light is controlled, for each pixel, by means of an ON/OFF state of a corresponding one of the pixel switching elements 5. A voltage applied to each liquid crystal capacitor is varied in accordance with a data signal. A level of the applied voltage determines brightness of each pixel. Since the liquid crystal display device carries out a color display by additive color mixture of the three primary colors (R, G, and B) of light, the pixels are arranged in sets of three pixels respectively corresponding to R, G, and B.

In respective pixel regions, the gate lines GL1 through GLm are connected to respective gate terminals of the pixel switching elements 4; the data signal lines DL1 through DLn are connected to respective source terminals of the pixel switching elements 4; and the pixel electrodes 6 are connected to respective drain terminals of the pixel switching elements 4.

As described above, the liquid crystal display device of the present embodiment is an active matrix liquid crystal display device driven by the SSD method. According to this driving method, a source signal (data signal) is, when outputted, divided into three during a single horizontal scanning period. Liquid crystal display devices of this type are driven by the method according to which each set of a plurality of data signal lines (in the present embodiment, three data signal lines respectively corresponding to R, G, and B) is driven by an output circuit (described below) common to the above plurality of data signal lines. Thus, the plurality of data signal lines DL1 through DLn are bundled into sets of three data signal lines provided adjacent to one another. The data signal lines DL1 through DLn are, in such sets of three, connected to respective output signal lines (data signal output lines) D1 through Dn/3 of the data line driving circuit 1. Each of the data signal lines DL1 through DLn is connected to one of the output signal lines D1 through Dn/3 via a corresponding one of the gate switching elements 4.

Each of the gate switching elements 4 connected to the data signal lines DL1 through DLn has a gate terminal connected to the data line selection circuit 3 via one of data line selection lines GLa, GLb, and GLc.

The data line selection circuit 3 sequentially switches on and off respective gate switching elements 4 provided to three data signal lines in each set. This causes such three data signal lines in each set to be sequentially connected to a corresponding one of the output signal lines. For example, the data signal lines DL1, DL2, and DL3 form a set, which is connected to the output signal line D1. Control of the ON/OFF state of each corresponding gate switching element 4 by the data line selection circuit 3 causes the data signal lines DL1, DL2, and DL3 to be sequentially and electrically connected to the output signal line D1.

The data signal lines DL1, DL2, and DL3 are connected to their respective columns of pixel electrodes 6 for respective pixels, each of which columns corresponds to one of the three primary colors, i.e., red (R), green (G), and blue (B), constituting a display color. The driving circuit 1 includes data output circuits (not shown) for the respective sets of three data signal lines corresponding to R, G, and B. Each of the data output circuits drives a corresponding set of three data signal lines corresponding to R, G, and B. Each data output circuit supplies data to a corresponding set of data signal lines in the order of R, G, and B. For the purpose of not only increasing drive rate but also securing a certain time period necessary for each data signal line to write a data signal to corresponding pixels, data signal lines that are in the respective sets and corresponds to one color are driven simultaneously. Specifically, among all the data signal lines in the respective sets connected to the output signal lines D1 through Dn/3, data signal lines corresponding to R are first driven simultaneously; data signal lines corresponding to G are next driven simultaneously; and data signal lines corresponding to B are finally driven simultaneously.

Note that though the above description deals with an arrangement in which the data signal lines are switched in the order of R, G, and B, the order is not particularly limited to any specific one. Thus, the data signal lines may alternatively be provided with data signals in a different order.

(Operation of Liquid Crystal Display Device)

According to conventional liquid crystal display devices driven by the SSD method, the counter electrode is supplied with a voltage at a constant value while one gate line is active, i.e., during one horizontal scanning period. In order to prevent image burning in liquid crystals, a signal (hereinafter referred to as "a COM signal") supplied to the counter electrode normally has two potentials alternately outputted. In other words, an inversion driving is normally carried out. Specifically, the counter electrode is supplied with a voltage while a given gate line is active, whereas the counter electrode is supplied with a reversed voltage of the above voltage while another gate line adjacent to the above given gate line is active.

Figure 2:
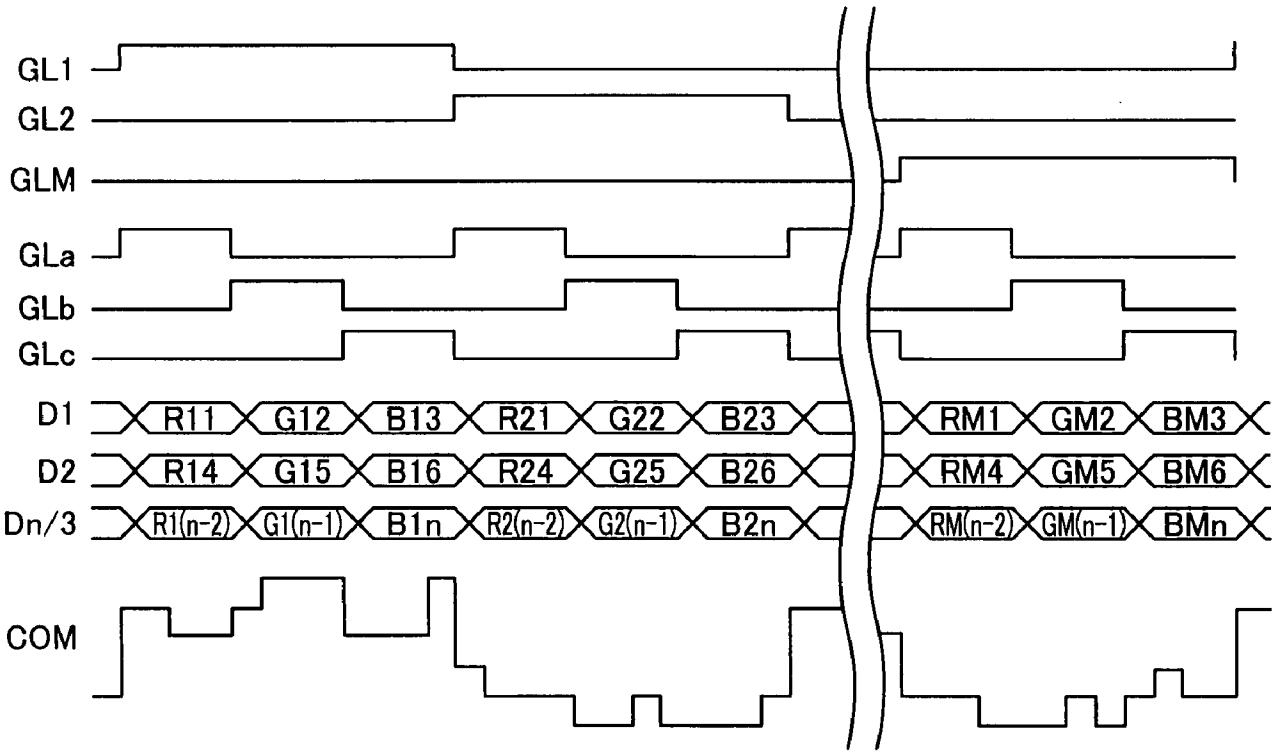
FIG. 2 is a timing chart illustrating an example of how a voltage applied to a counter electrode is varied over time in the liquid crystal display device of the present invention.

In contrast, the liquid crystal display device of the present invention is characterized by varying the voltage applied to the counter electrode during a single horizontal period. FIG. 2 is a timing chart illustrating how the voltage applied to the counter electrode of the liquid crystal display device is varied over time. With reference to FIG. 2, the following description deals with the COM signal supplied to the counter electrode 11 of the liquid crystal display device.

As illustrated in FIG. 2, the gate lines GL1 through Gm are sequentially supplied with scanning signals. Specifically, the gate lines GL1 through Gm are sequentially selected by the gate line driving circuit 102, and are thereby supplied with scanning signals from the gate line driving circuit 102. This causes each pixel switching element 5 connected to a selected gate line to have a gate turned ON. This causes each of the pixel switching elements 5 to be in an active state in which a source signal (i.e., data signal) can be supplied to a corresponding pixel electrode.

Further, as illustrated in FIG. 2, while each of the gate lines GL1 through Gm is selected, the data line selection lines GLa, GLb, and GLc are sequentially supplied with data line selection signals. The data line selection line GLa is connected to data lines corresponding to R pixels; the data line selection line GLb is connected to data signal lines corresponding to G pixels; and the data line selection line GLc is connected to data lines corresponding to B pixels. Thus, a sequential supply of data line selection signals to the data signal line selection lines GLa, GLb, and GLc causes the respective data lines, each of which is connected to pixels corresponding to one of R, G, and B, to be sequentially selected. For example, in FIG. 2, while the gate line GL1 is selected, the data line selection lines GLa, GLb, and GLc are sequentially supplied with data line selection signals. When a data line selection signal is supplied to a given data line selection line, each gate switching element connected to the given data line selection line is caused to have a gate turned ON. This allows a data signal from a corresponding output signal line to be supplied to each data signal line connected to such a switching element that is in an ON state. This consequently causes data signals from respective output signal lines to be sequentially supplied to corresponding data signal lines for respective columns of pixels each of which columns corresponds to one of R, G, and B.

Further, as illustrated in FIG. 2, while each of the gate lines GL1 through Gm is selected, the output signal lines D1 through Dn/3 are supplied with data signals simultaneously. Each output signal line is supplied with data signals for R, G, and B by time division. For example, in FIG. 2, while the gate line GL1 is selected, the output signal line D1 is supplied with data signals R11, G12, and B13 by time division; the output signal line D2 is supplied with data signals R14, G15, and B16 by time division; and the output signal line Dn/3 is supplied with data signals R1($n$−2), G1($n$−1), and B1$n$ by time division.

Each of the output signal lines D1 through Dn/3 is supplied with data signals for R, G, and B by time division at timings synchronizing with respective timings at which the data signal lines for the respective columns of pixels, each of which columns corresponds to one of R, G, and B, are sequentially selected by the above data line selection signals. For example, in FIG. 2, while the gate line GL1 is selected, the data line selection lines GLa, GLb, and GLc are sequentially supplied with data line selection signals. The data line selection lines GLa, GLb, and GLc are supplied with data line selection signals at respective timings each of which synchronizes with a corresponding one of timings at which each of the output signal lines D1 through Dn/3 is sequentially supplied with data signals for R, G, and B by time division.

This makes it possible to supply (i) a data signal for R to each data signal line for pixels corresponding to R, (ii) a data signal for G to each data signal line for pixels corresponding to G, and (iii) a data signal for B to each data signal line for pixels corresponding to B.

According to the liquid crystal display device of the present invention, the voltage applied to the counter electrode 11 during a single horizontal period is variable. More specifically, according to the liquid crystal display device of the present invention, while one gate line is active and, for this line, data signals are sequentially written to (i) pixels corresponding to R, (ii) pixels corresponding to G, and (iii) pixels corresponding to B, the voltage (COM signal) applied to the counter electrode 11 is varied instead of being maintained at a constant value.

As illustrated in the timing chart of FIG. 2, the voltage applied to the counter electrode 11 during a single horizontal period can be varied, e.g., by selecting, with use of a program, one potential from a plurality of counter potentials obtained from an experiment conducted in advance. More specifically, this can be achieved by an arrangement in which: the counter electrode control section 10 is arranged so as to be capable of selecting one potential from potentials which are slightly different from one another (practically, by a difference of approximately 10 mV), unlike a conventional COM potential; respective potentials or respective COM signal waveforms suitable for R, G, and B are determined in an experiment conducted during a designing process; and the counter electrode control section 10 is operated by using a program which causes the respective potentials or respective COM signal waveforms suitable for R, G, and B to be sequentially outputted in synchronization with timings at each of which data signals are supplied.

This allows the following voltages (i) to (iii) to be different from one another in the liquid crystal display device of the present invention: (i) an effective voltage applied to the counter electrode 11 when a data signal for R is being supplied to each pixel electrode 6 for R; (ii) an effective voltage applied to the counter electrode 11 when a data signal for G is being supplied to each pixel electrode 6 for G; and (iii) an effective voltage applied to the counter electrode 11 when a data signal for B is being supplied to each pixel electrode 6 for B. This allows the respective luminances of R, G, and B to be independently adjusted.

The liquid crystal display device of the present invention may preferably be arranged so that the voltage applied to the counter electrode 11 is varied at timings synchronizing with timings at which the data signals for the primary colors (R, G, and B) supplied to the output signal lines D1 through Dn/3 by time division are switched from one another.

Figure 3:
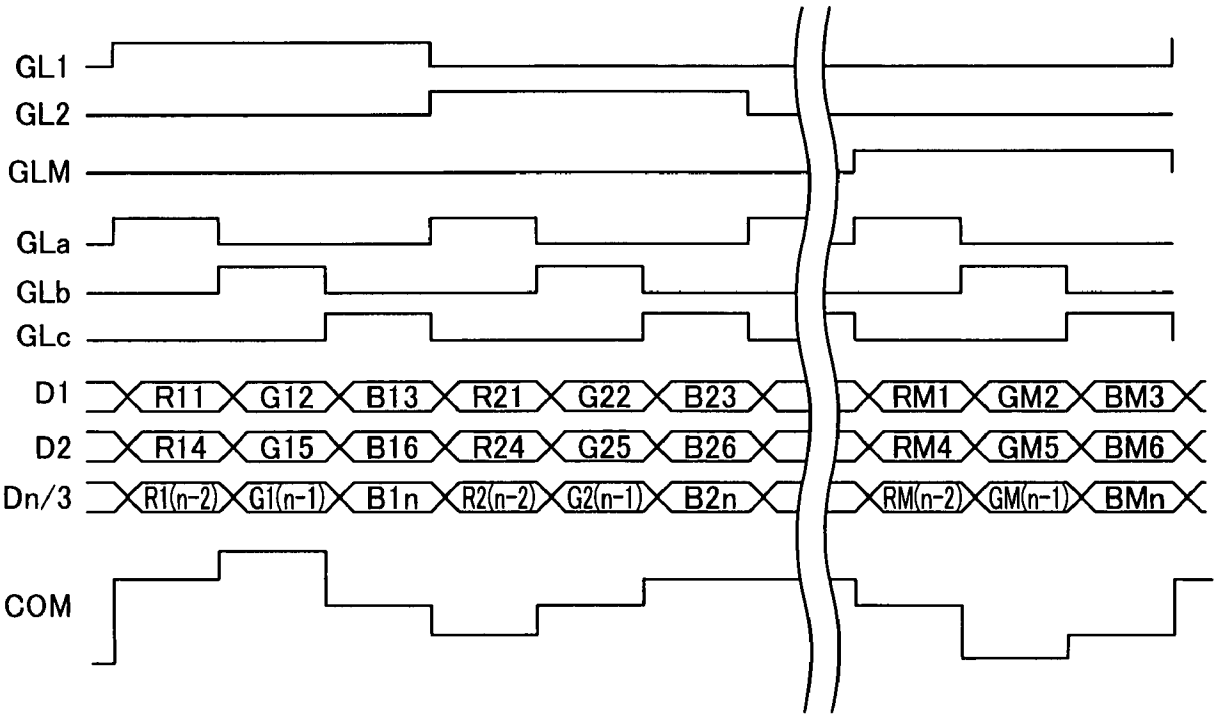
FIG. 3 is a timing chart illustrating another example of how a voltage applied to a counter electrode is varied over time in the liquid crystal display device of the present invention.

FIG. 3 is a timing chart illustrating an example of how the voltage applied to the counter electrode of the liquid crystal display device is varied over time. Respective signal waveforms illustrated in FIG. 3 for the gate lines, the data line selection lines, and the output signal lines are identical to those illustrated in FIG. 2, and are thus not described here.

In the example illustrated in FIG. 3, the voltage (COM signal) applied to the counter electrode is varied at timings synchronizing with timings at which signals supplied to the output signal lines D1 through Dn/3 are switched. Specifically, while three types of data signals corresponding to R, G, and B are supplied to each of the output signal lines D1 through Dn/3 by time division, the counter electrode 11 is supplied with voltages having different levels respectively in (i) a period during which the data signal for R is being supplied, (ii) a period during which the data signal for G is being supplied, and (iii) a period during which the data signal for B is being supplied. For example, while the gate line GL1 is selected, the following COM signal potentials are different from one another: a COM signal potential applied when the output signal line D1 is being supplied with a data signal R11 for R; a COM signal potential applied when the output signal line D1 is being supplied with a data signal G12 for G; and a COM signal potential applied when the output signal line D1 is being supplied with a data signal B13 for B.

This makes it possible to independently vary the voltage applied to the counter electrode 11 for each of R, G, and B. This in turn makes it possible to independently adjust the respective luminances of R, G, and B.

Note that the voltage applied for each of R, G, and B to the counter electrode 11 may be varied for each horizontal scanning period, and that the arrangement is not limited to the above.

The liquid crystal display device of the present invention may preferably be arranged so that the voltage applied to the counter electrode 11 is varied by using data line selection signals supplied to the data line selection lines GLa, GLb, and GLc.

Figure 4:
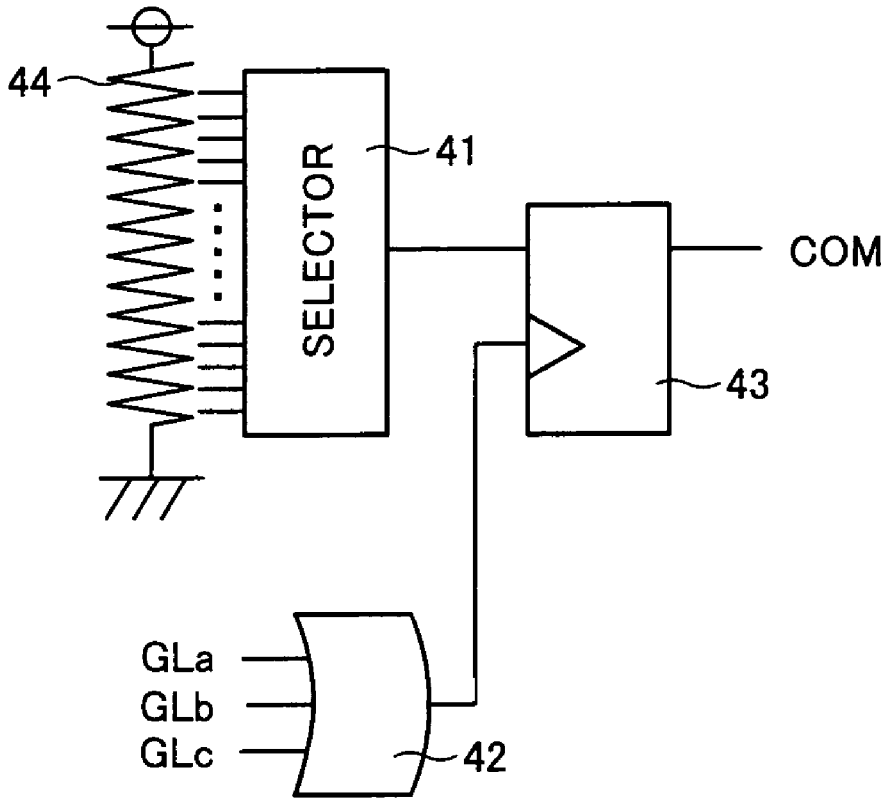
FIG. 4 is a diagram illustrating an example of a circuit constituting a counter electrode control section

FIG. 4 is a diagram illustrating an example of a circuit constituting the counter electrode control section 10. As illustrated in FIG. 4, the counter electrode control section 10 includes: selectors 41 and 42; an output control section 43; and a resistor 44. The resistor 44 has one end connected to a power supply having a voltage, and has the other end connected to ground. The selector 41 is connected to the resistor 44 via a plurality of terminals, and thereby selects, from a plurality of voltage values, a value of a voltage to be outputted. The selector 42 is connected to the data line selection lines GLa, GLb, and GLc. In accordance with each data line selection signal supplied, the selector 42 supplies, to the output control section 43, a signal indicating that a different data signal line has been selected. In accordance with such a signal supplied from the selector 42, the output control section 43 draws, from the selector 41, a voltage having another value, and supplies this voltage to the counter electrode 11 as a COM signal.

This makes it possible to vary the voltage applied to the counter electrode 11 during a single horizontal period, by using the data line selection circuit 3 included in the liquid crystal display device driven by the SSD method. This in turn makes it possible to independently adjust the respective luminances of R, G, and B in a simple arrangement.

The liquid crystal display device of the present invention may preferably be arranged so that, in a case where the primary colors corresponding to selected ones of the plurality of data signal lines are same for different horizontal scanning periods, the voltage applied to the counter electrode is identical.

Figure 5:
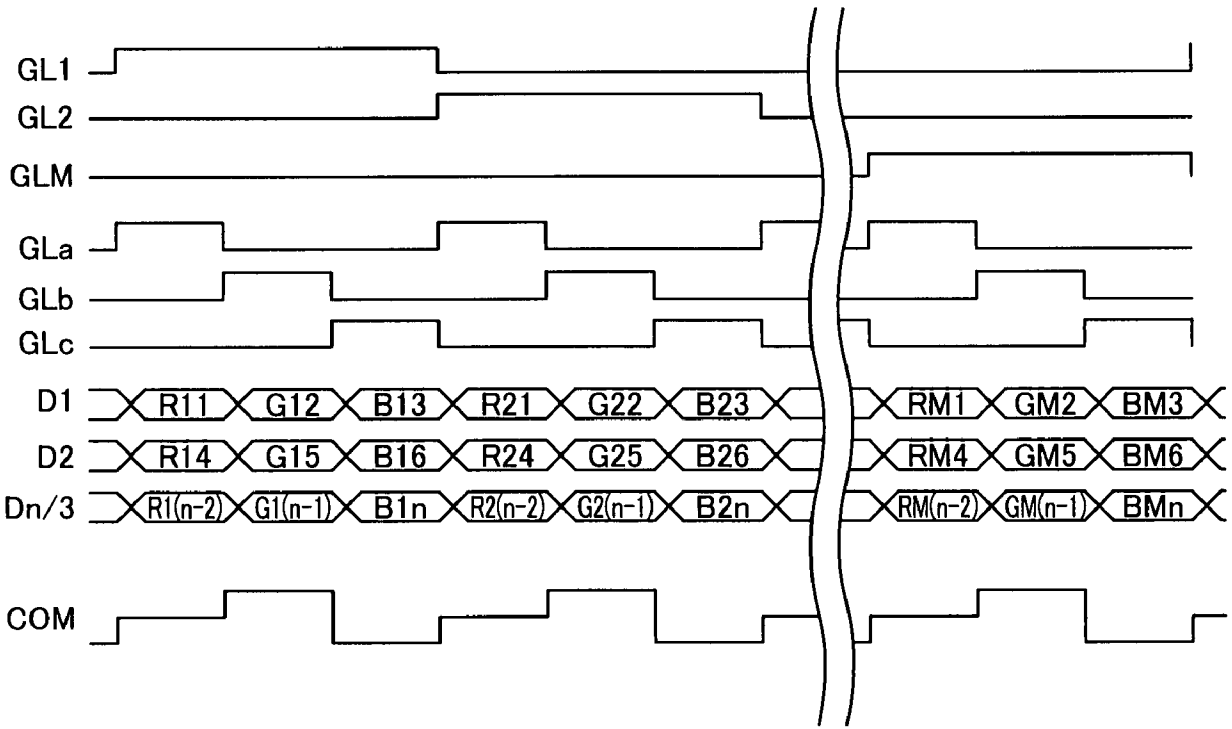
FIG. 5 is a timing chart illustrating another example of how a voltage applied to a counter electrode is varied over time in the liquid crystal display device of the present invention.

FIG. 5 is a timing chart illustrating an example of how the voltage applied to the counter electrode of the liquid crystal display device is varied over time. Respective signal waveforms illustrated in FIG. 5 for the gate lines, the data line selection lines, and the output signal lines are identical to those illustrated in FIG. 2, and are thus not described here.

In the example illustrated in FIG. 5, the voltage (COM signal) applied to the counter electrode is varied at timings synchronizing with timings at which signals supplied to the output signal lines D1 through Dn/3 are switched, i.e., at timings at which respective sets of data signal lines are sequentially selected, each of which sets corresponds to one of R, G, and B. In addition, according to the example illustrated in FIG. 5, the voltage applied to the counter electrode 11 has a single value for each of the following periods for different horizontal scanning periods: a period during which each output signal line is being supplied with a data signal for R; a period during which each output signal line is being supplied with a data signal for G; and a period during which each output signal line is being supplied with a data signal for B. For example, the following COM signal potentials are identical to each other: (i) a COM signal potential applied when the gate line GL1 is selected and the output signal line D1 is being supplied with a data signal R11 for R; and (ii) a COM signal potential applied when the gate line GL2 is selected and the output signal line D1 is being supplied with a data signal R21 for R. Similarly, the following COM signal potentials are also identical to each other: (i) a COM signal potential applied when the gate line GL1 is selected and the output signal line D1 is being supplied with a data signal G12 for G; and (ii) a COM signal potential applied when the gate line GL2 is selected and the output signal line D1 is being supplied with a data signal G22 for G. Further, the following COM signal potentials are also identical to each other: (i) a COM signal potential applied when the gate line GL1 is selected and the output signal line D1 is being supplied with a data signal B13 for B; and (ii) a COM signal potential applied when the gate line GL2 is selected and the output signal line D1 is being supplied with a data signal G23 for B.

As a result of the above, for different horizontal scanning periods, the voltage applied to the counter electrode 11 can be controlled uniformly for each period during which each output signal line is being supplied with a data signal for one color, i.e., during which data signal lines corresponding to one color are selected. This in turn facilitates independently adjusting the respective luminances of R, G, and B.

Figure 6:
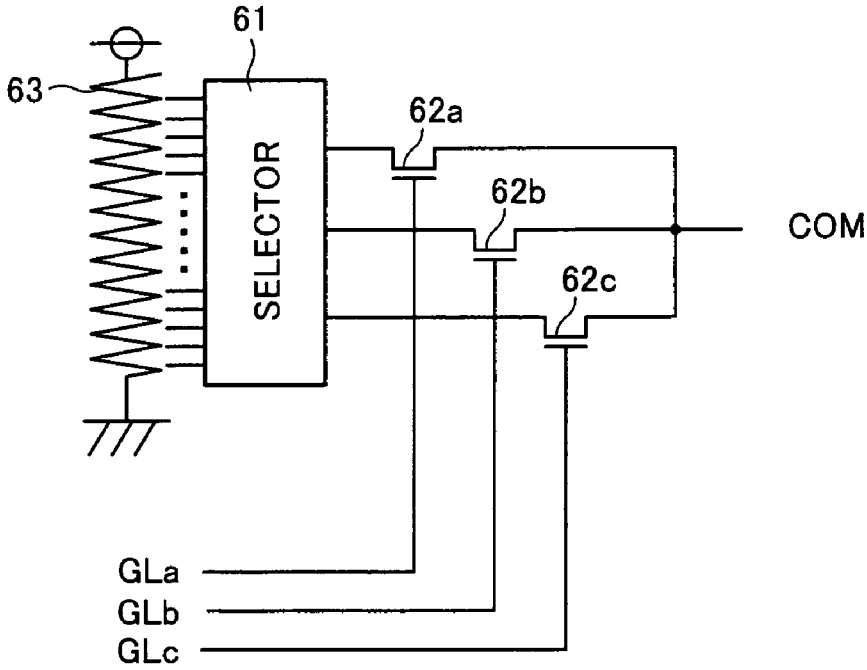
FIG. 6 is a diagram illustrating an example of a circuit constituting a counter electrode control section for achieving the voltage illustrated in the timing chart of FIG. 5.

FIG. 6 is a diagram illustrating an example of a circuit constituting a counter electrode control section 10 for achieving the voltage illustrated in the timing chart of FIG. 5. As illustrated in FIG. 6, the counter electrode control section 10 includes: a selector 61; switching elements 62*a*, 62*b*, and 62*c*; and a resistor 63. The resistor 63 has one end connected to a power supply voltage, and has the other end connected to ground. The selector 61 is connected to the resistor 63 via a plurality of terminals, and thereby selects, from a plurality of voltage values, a value of a voltage to be outputted.

The switching elements 62*a*, 62*b*, and 62*c* are connected to the selector 61 via respective terminals having voltages different from one another. The switching elements 62*a*, 62*b*, and 62*c* are also connected to the data line selection lines GLa, GLb, and GLc, respectively.

When a data line selection signal is supplied to the data line selection line GLa, the switching element 62*a* is turned ON. This causes the voltage of the terminal via which the switching element 62*a* is connected to the selector 61 to be supplied to the counter electrode 11 as a COM signal. Similarly, when a data selection signal is supplied to the data line selection line GLb, the switching element 62*b* is turned ON. This causes the voltage of the terminal via which the switching element 62*b* is connected to the selector 61 to be supplied to the counter electrode 11 as a COM signal. Further, when a data selection signal is supplied to the data line selection line GLc, the switching element 62*c* is turned ON. This causes the voltage of the terminal via which the switching element 62*c* is connected to the selector 61 to be supplied to the counter electrode 11 as a COM signal.

The liquid crystal display device of the present invention may preferably be arranged so that the voltage applied to the counter electrode has polarities reversed from each other; and, in a case where the primary colors (R, G, and B) corresponding to selected ones of the plurality of data signal lines are same for horizontal scanning periods corresponding to an identical polarity, the voltage applied to the counter electrode is identical.

Figure 7:
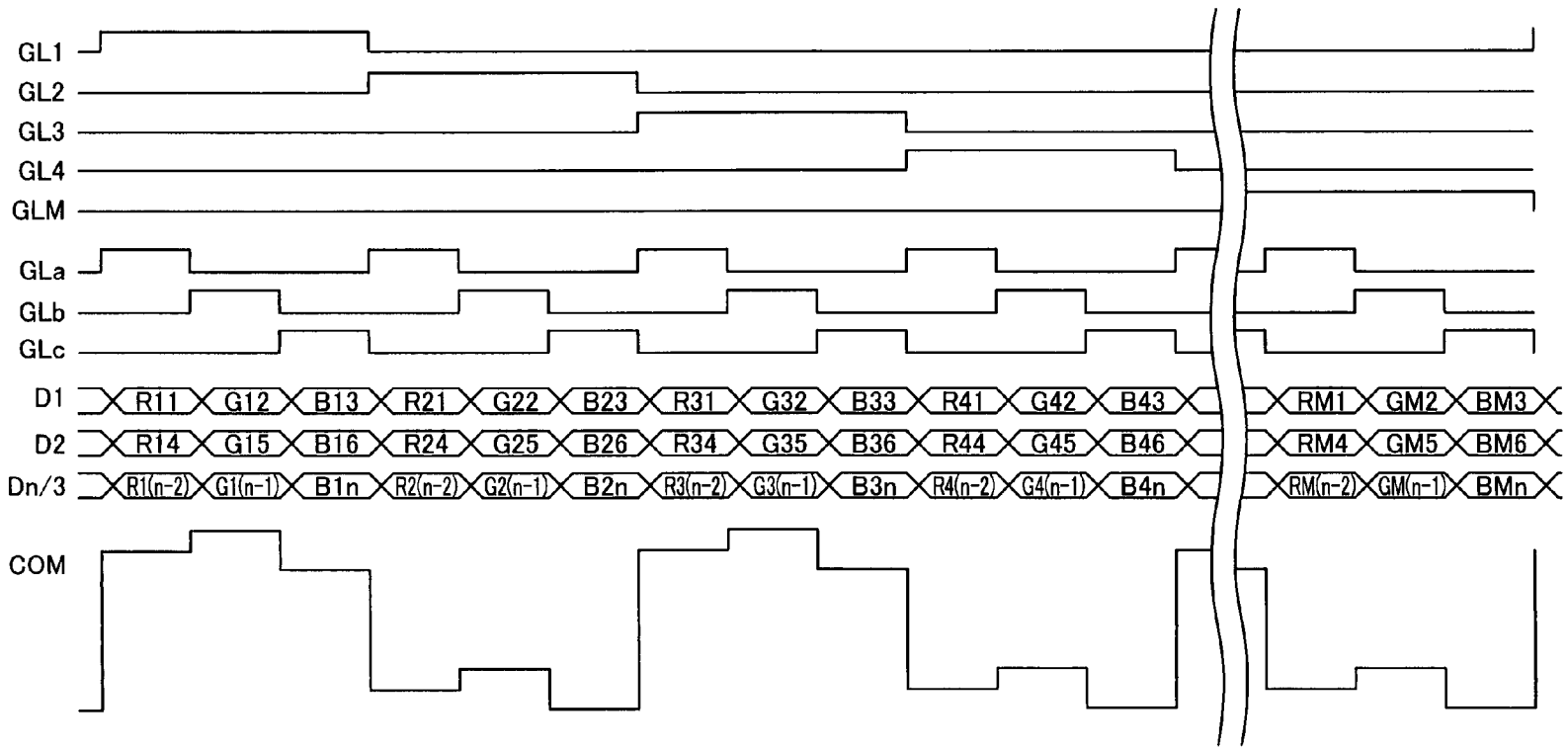
FIG. 7 is a timing chart illustrating another example of how a voltage applied to a counter electrode is varied over time in the liquid crystal display device of the present invention.

FIG. 7 is a timing chart illustrating an example of how the voltage applied to the counter electrode of the liquid crystal display device is varied over time. Respective signal waveforms illustrated in FIG. 7 for the gate lines, the data line selection lines, and the output signal lines are identical to those illustrated in FIG. 2, and are thus not described here.

In the example illustrated in FIG. 7, the voltage (COM signal) applied to the counter electrode is varied at timings synchronizing with timings at which signals supplied to the output signal lines D1 through Dn/3 are switched, i.e., at timings at which respective sets of data lines are sequentially selected, each of which sets corresponds to one of R, G, and B. Further, according to the example illustrated in FIG. 7, polarities of the voltage (COM signal) applied to the counter electrode 11 has polarities that are reversed from each other. Specifically, the counter electrode 11 is alternately supplied with a positive voltage and a negative voltage each for one horizontal period after another. In addition, according to the example illustrated in FIG. 7, the voltage applied to the counter electrode 11 has a single value for each of the following periods for horizontal scanning periods corresponding to one polarity: a period during which each output signal line is being supplied with a data signal for R; a period during which each output signal line is being supplied with a data signal for G; and a period during which each output signal line is being supplied with a data signal for B. For example, the following COM signal potentials are identical to each other: (i) a COM signal potential applied when the gate line GL1 is selected and the output signal line D1 is being supplied with a data signal R11 for R; and (ii) a COM signal potential applied when the gate line GL3 is selected and the output signal line D1 is being supplied with a data signal R31 for R. Similarly, the following COM signal potentials are also identical to each other: (i) a COM signal potential applied when the gate line GL1 is selected and the output signal line D1 is being supplied with a data signal G12 for G; and (ii) a COM signal potential applied when the gate line GL3 is selected and the output signal line D1 is being supplied with a data signal G32 for G. Further, the following COM signal potentials are also identical to each other: (i) a COM signal potential applied when the gate line GL1 is selected and the output signal line D1 is being supplied with a data signal B13 for B; and (ii) a COM signal potential applied when the gate line GL3 is selected and the output signal line D1 is being supplied with a data signal B33 for B.

Consequently, in the liquid crystal display device having an arrangement in which polarities of the voltage applied to the counter electrode are reversed, for horizontal scanning periods corresponding to the identical polarity, the voltage applied to the counter electrode 11 can be controlled uniformly for each period during which each output signal line is being supplied with a data signal for one color, i.e., during which data signal lines corresponding to one color are selected. This in turn facilitates independently adjusting the respective luminances of R, G, and B, and also prevents image burning in liquid crystals.

Figure 8:
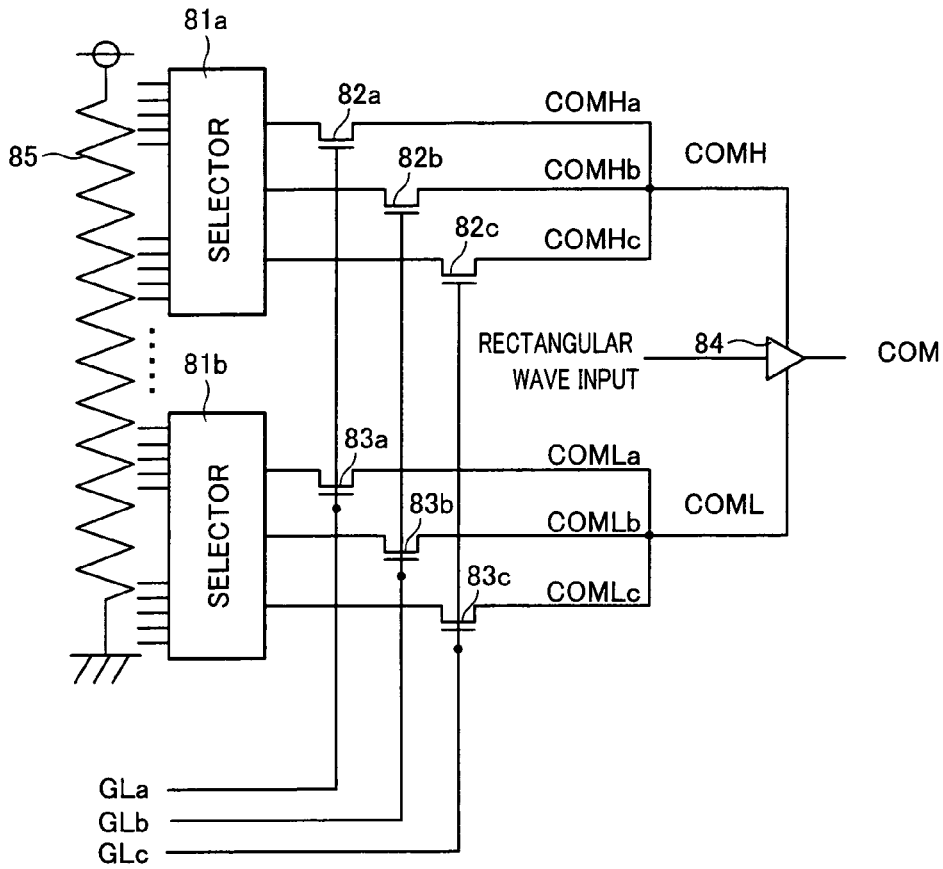
FIG. 8 is a diagram illustrating an example of a circuit constituting a counter electrode control section for achieving the voltage illustrated in the timing chart of FIG. 7.

FIG. 8 is a diagram illustrating an example of a circuit constituting a counter electrode control section 10 for achieving the voltage illustrated in the timing chart of FIG. 7. As illustrated in FIG. 8, the counter electrode control section 10 includes: selectors 81*a* and 81*b*; switching elements 82*a*, 82*b*, 82*c*, 83*a*, 83*b*, and 83*c*; an output buffer 84; and a resistor 85. The resistor 85 has one end connected to a power supply voltage, and has the other end connected to ground. Each of the selectors 81*a* and 81*b* is connected to the resistor 85 via a plurality of terminals, and thereby selects, from a plurality of voltage values, a value of a voltage to be outputted.

The switching elements 82*a*, 82*b*, and 82*c* are connected to the selector 81*a* via respective terminals having voltages different from one another. The switching elements 82*a*, 82*b*, and 82*c* are also connected to the data line selection lines GLa, GLb, and GLc, respectively. When a data line selection signal is supplied to the data line selection line GLa, the switching element 82*a* is turned ON. This causes the voltage (COMHa; COM potential applied when a data signal for R is being applied to the liquid crystal as a negative voltage) of the terminal via which the switching element 82*a* is connected to the selector 81*a* to be supplied to the output buffer 84 as a negative COM signal (COMH). Similarly, when a data selection signal is supplied to the data line selection line GLb, the switching element 82*b* is turned ON. This causes the voltage (COMHb; COM potential applied when a data signal for G is being applied to the liquid crystal as a negative voltage) of the terminal via which the switching element 82*b* is connected to the selector 81*a* to be supplied to the output buffer 84 as a negative COM signal (COMH). Further, when a data selection signal is supplied to the data line selection line GLc, the switching element 82*c* is turned ON. This causes the voltage (COMHc; COM potential applied when a data signal for B is being applied to the liquid crystal as a negative voltage) of the terminal via which the switching element 82*c* is connected to the selector 81*a* to be supplied to the output buffer 84 as a negative COM signal (COMH).

The switching elements 83*a*, 83*b*, and 83*c* are connected to the selector 81*b* via respective terminals having voltages different from one another. The switching elements 83*a*, 83*b*, and 83*c* are also connected to the data line selection lines GLa, GLb, and GLc, respectively. When a data selection signal is supplied to the data line selection line GLa, the switching element 83*a* is turned ON. This causes the voltage (COMLa; COM potential applied when a data signal for R is being applied to the liquid crystal as a positive voltage) of the terminal via which the switching element 83*a* is connected to the selector 81*b* to be supplied to the output buffer 84 as a positive COM signal (COML). Similarly, when a data selection signal is supplied to the data line selection line GLb, the switching element 82*b* is turned ON. This causes the voltage (COMLb; COM potential applied when a data signal for G is being applied to the liquid crystal as a positive voltage) of the terminal via which the switching element 83*b* is connected to the selector 81*b* to be supplied to the output buffer 84 as a positive COM signal (COML). Further, when a data selection signal is supplied to the data line selection line GLc, the switching element 83*c* is turned ON. This causes the voltage (COMLc; COM potential applied when a data signal for B is being applied to the liquid crystal as a positive voltage) of the terminal via which the switching element 83*c* is connected to the selector 81*b* to be supplied to the output buffer 84 as a positive COM signal (COML).

The output buffer 84 is supplied with signals (e.g., signals each generated for a single horizontal scanning period of a gate line) indicating that a different gate line has been selected. The output buffer 84 alternately outputs COMH and COML as a COM signal in accordance with the rectangular waves supplied. This consequently causes the output buffer 84 to alternately output COMH and COML each for one line after another.

The liquid crystal display device of the present invention may preferably be arranged so that, in a case where the primary colors (R, G, and B) corresponding to the selected ones of the plurality of data signal lines are same between any two horizontal scanning periods corresponding to the polarities different from each other, an absolute value of a difference between a center voltage and a positive voltage applied to the counter electrode is equal to an absolute value of a difference between the center voltage and a negative voltage applied to the counter electrode 11.

Figure 9:
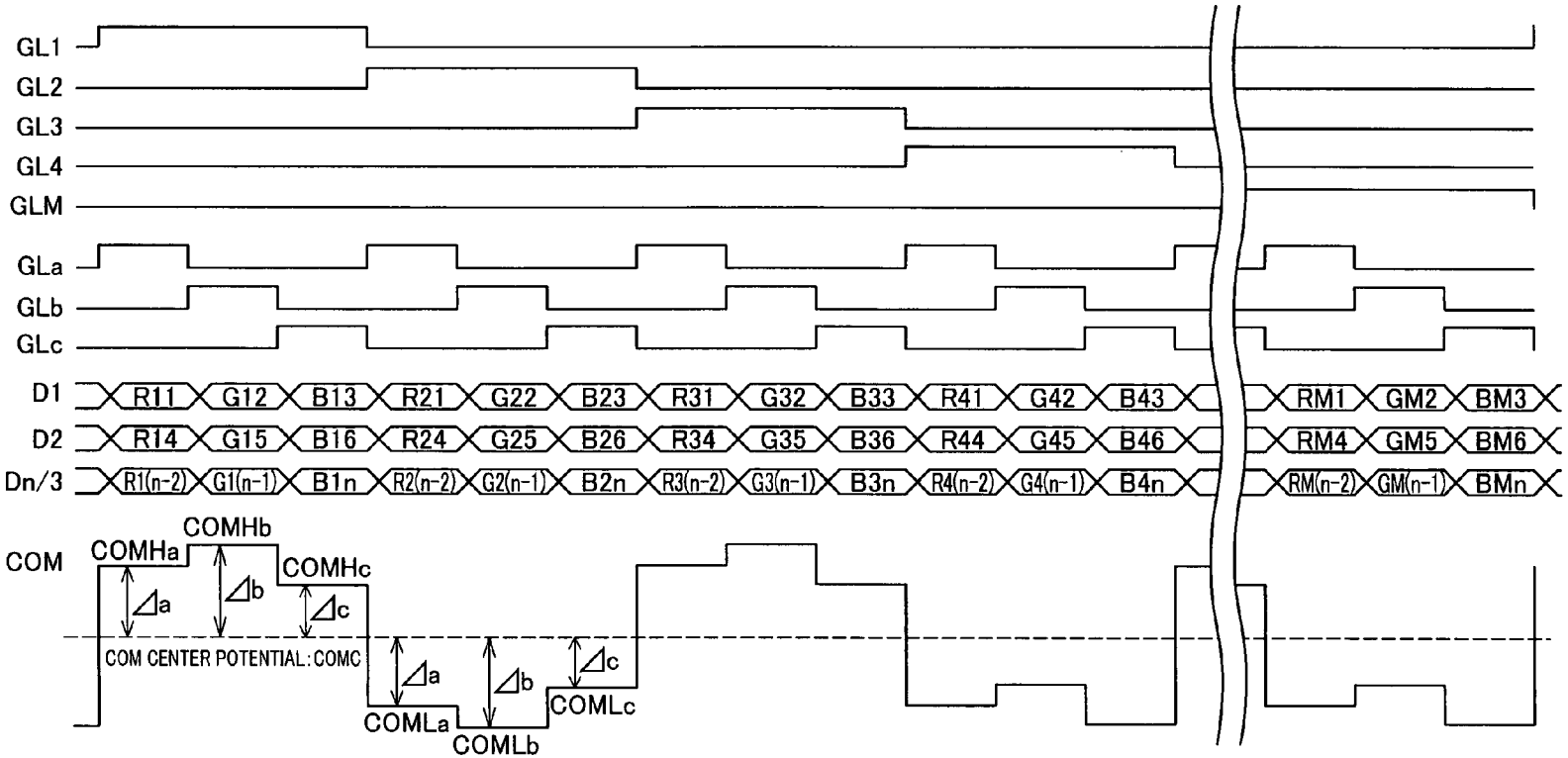
FIG. 9 is a timing chart illustrating another example of how a voltage applied to a counter electrode is varied over time in the liquid crystal display device of the present invention.
Figure 10:
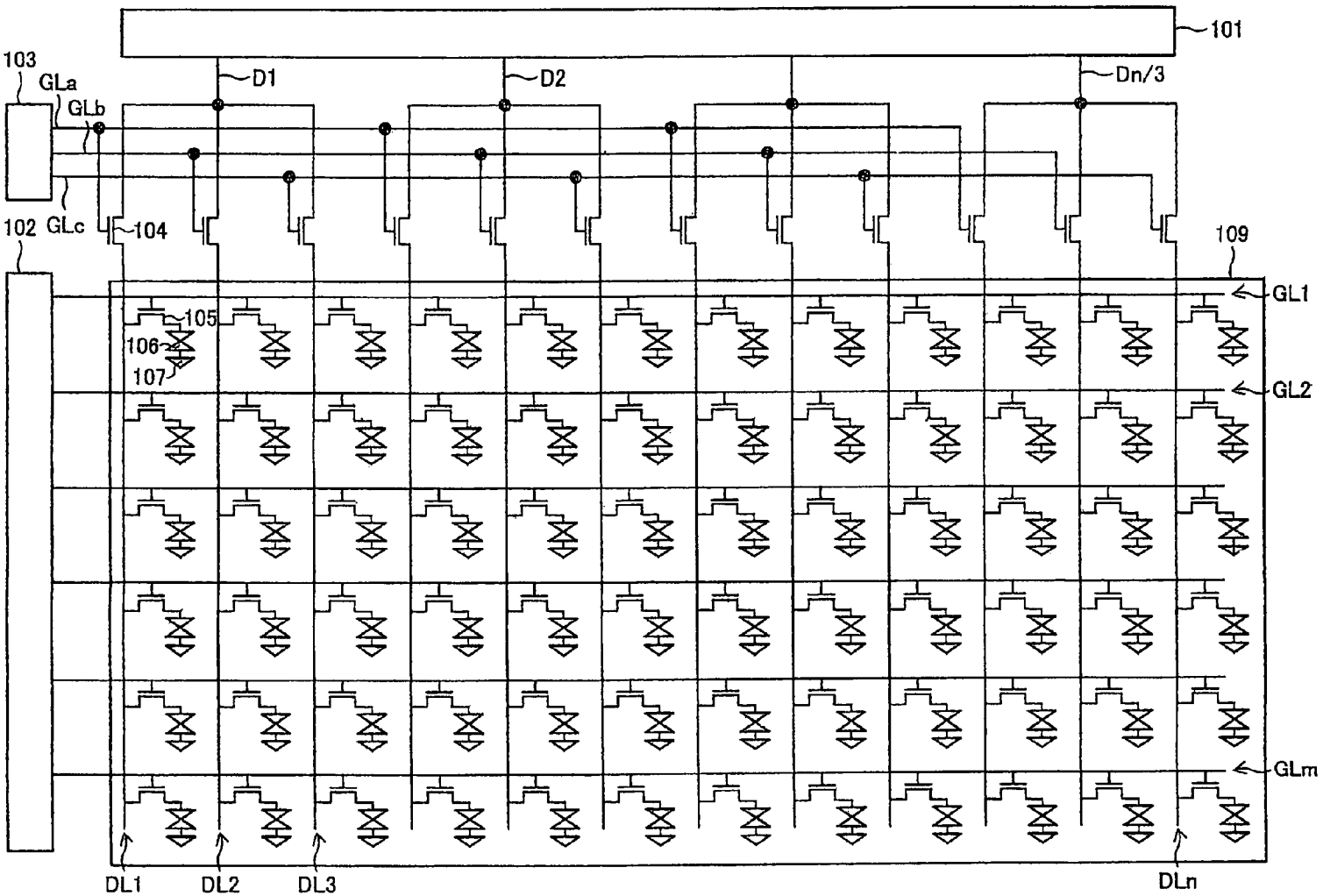
FIG. 10 PRIOR ART
FIG. 10 is an equivalent circuit diagram illustrating an arrangement of an active matrix liquid crystal display device driven by a SSD method, the diagram serving to explain a conventional technique.
Figure 11:
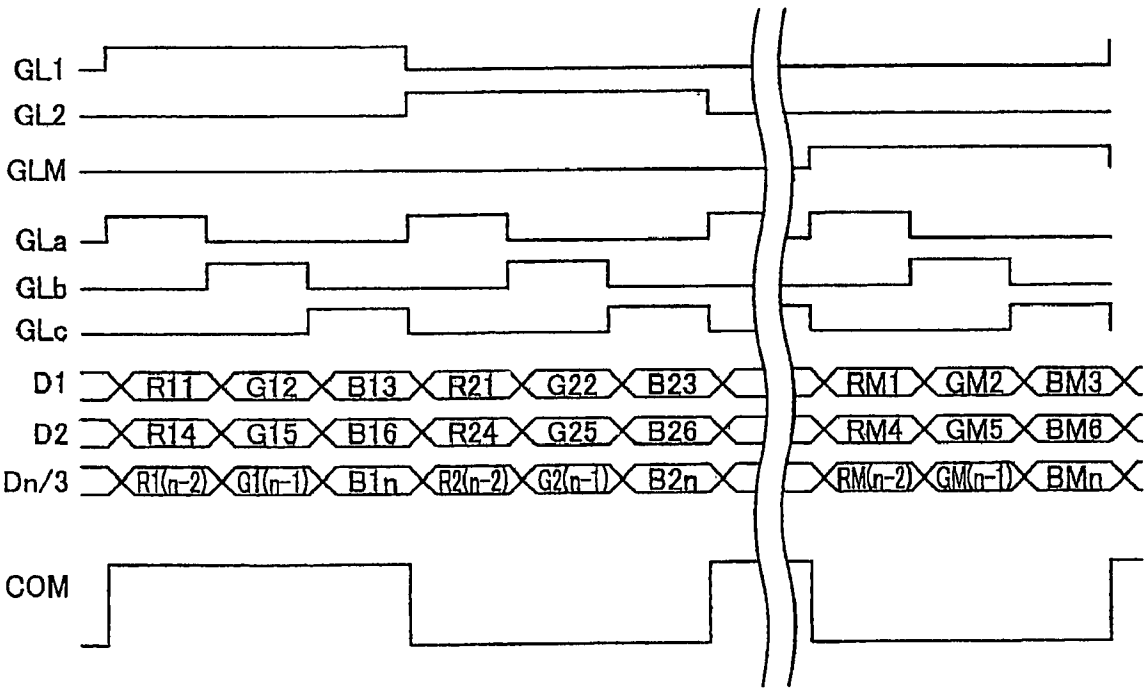
PRIOR ART FIG. 11
FIG. 11 is a timing chart illustrating an inversion driving of a counter electrode of the liquid crystal display device driven by the SSD method, the chart serving to explain a conventional technique.
Figure 12:
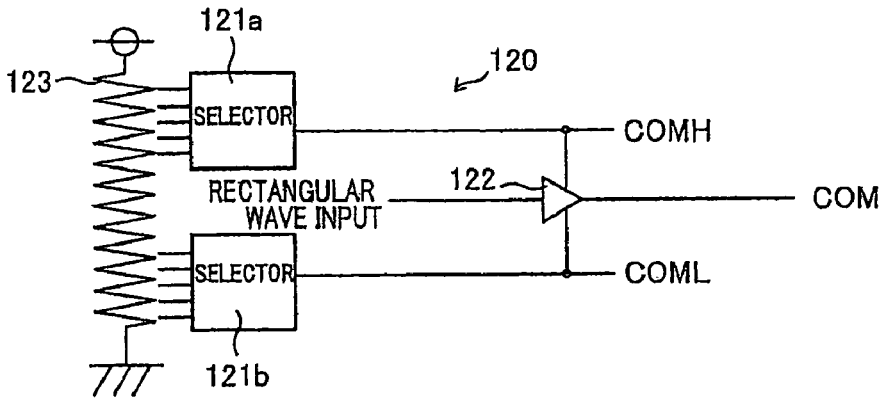
FIG. 12 is a circuit diagram for generating a voltage applied to the counter electrode for the line inversion driving, the diagram serving to explain a conventional technique.
Figure 13:
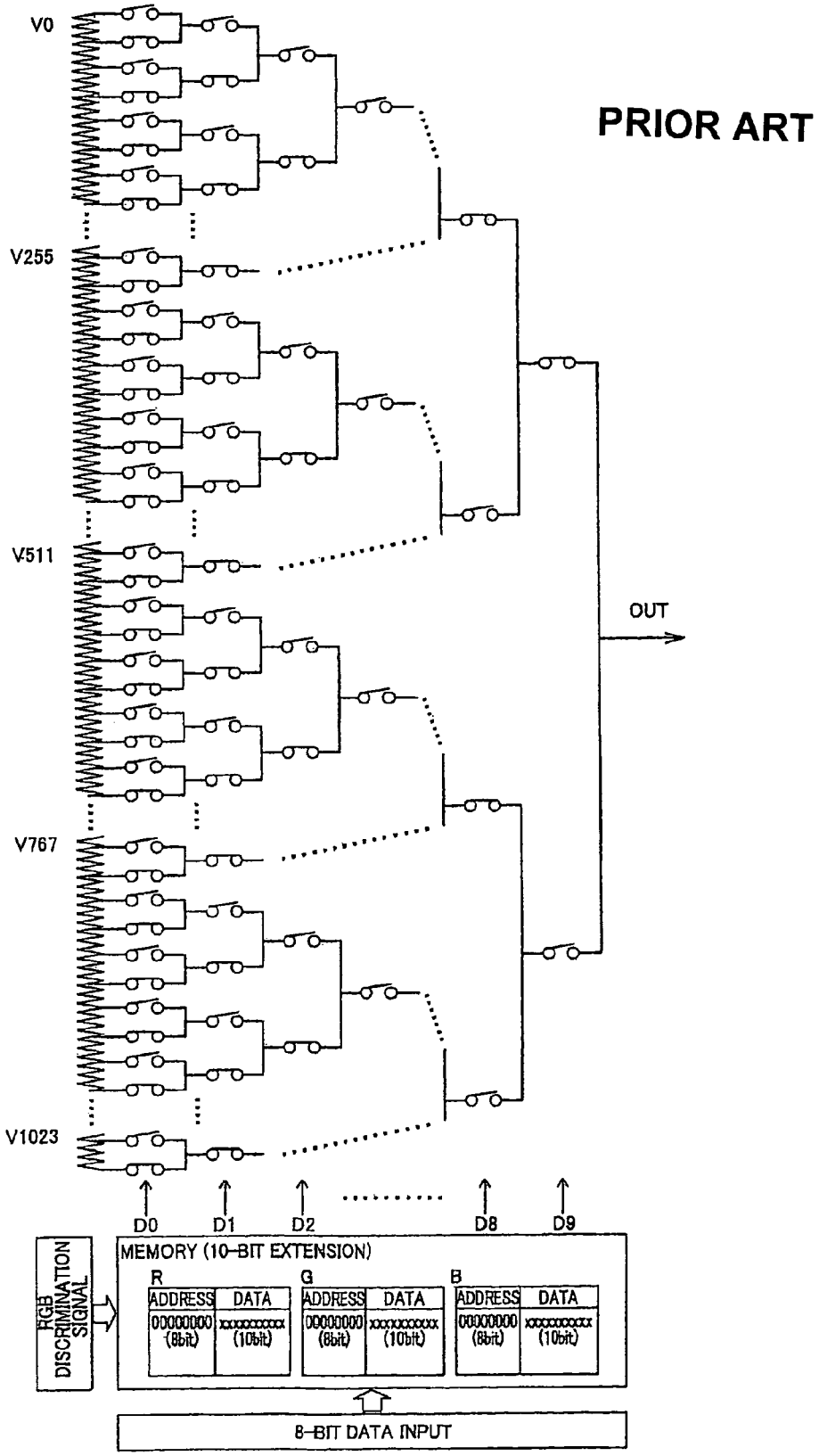
FIG. 13 is a circuit diagram of a conventional technique for independently adjusting each of source voltages of R, G, and B, the diagram serving to explain the conventional technique.

FIG. 9 is a timing chart illustrating an example of how the voltage applied to the counter electrode of the liquid crystal display device is varied over time. Respective signal waveforms illustrated in FIG. 7 for the gate lines, the data line selection lines, and the output signal lines are identical to those illustrated in FIG. 2, and are thus not described here.

In the example illustrated in FIG. 9, as in the example illustrated in FIG. 7, in a case where the primary color (R, G, or B) is identical for selected data signal lines for respective horizontal scanning periods each corresponding to one polarity, the voltage applied to the counter electrode is identical. Further, according to the example illustrated in FIG. 9, in a case where the primary colors (R, G, and B) corresponding to the selected ones of the plurality of data signal lines are same between any two horizontal scanning periods corresponding to the polarities different from each other, an absolute value of a difference between a center voltage and a positive voltage applied to the counter electrode is equal to an absolute value of a difference between the center voltage and a negative voltage applied to the counter electrode 11. For example, the following absolute values are equal to each other: (i) an absolute value of a difference between a center potential (COMC) and a COM signal potential (COMHa) applied when the gate line GL1 is selected and the output signal line D1 is being supplied with a data signal R11 for R; and (ii) an absolute value of a difference between the center potential (COMC) and a COM signal potential (COMLa) applied when the gate line GL2 is selected and the output signal line D1 is being supplied with a data signal R21 for R.

Consequently, in the liquid crystal display device having an arrangement in which polarities of the voltage applied to the counter electrode are reversed, the voltage applied to the counter electrode 11 can be controlled uniformly for each period during which each output signal line is being supplied, irrespective of polarity, with a data signal for one color for different horizontal scanning periods, i.e., during which data signal lines corresponding to one color are selected. This in turn facilitates independently adjusting the respective luminances of R, G, and B, and also prevents image burning in liquid crystals.

Note that while the present embodiment describes, as an example, a case where the data signal lines form sets of three, the number of data signal lines for forming a single set may be other than three, and is therefore not particularly limited to any specific number. Note also that while the present embodiment describes a case where each horizontal scanning period is divided into three, each horizontal scanning period may be divided into, e.g., six or nine instead. Therefore, the number into which each horizontal scanning period is divided is not particularly limited to any specific number. Note further that while the present embodiment describes, as an example, a case where the display color is constituted by the three primary colors of R, G, and B, the display color may be constituted by primary colors other than R, G, and B. Therefore, the primary colors are not particularly limited to any specific ones.

The present invention may alternatively be defined as below.

(First Arrangement)

An active matrix display device including: a plurality of data signal lines; a plurality of scanning signal lines; and pixels individually provided at each of intersections of the plurality of data signal lines and the plurality of scanning signal lines, the plurality of data signal lines being grouped into sets each including data signal lines, each of the data signal lines in each set being provided with a switch at an end located upstream in a flow in which a data signal is supplied, the data signal lines in each set being connected to one another at their respective ends located upstream of their respective switches in the flow in which the data signal is supplied, wherein a liquid crystal driving voltage applied to a COM electrode has a potential varied at an arbitrary timing.

(Second Arrangement)

The active matrix display device having the first arrangement, where the potential of the liquid crystal driving voltage applied to the COM electrode is varied at a timing synchronizing with a timing at which the plurality of data signal lines are switched.

(Third Arrangement)

The active matrix display device having the first arrangement, where the potential of the liquid crystal driving voltage applied to the COM electrode is varied (i) at a timing synchronizing with a timing at which the plurality of data signal lines are switched and (ii) with use of a data line selection signal for simultaneously driving data signal lines corresponding to one color.

(Fourth Arrangement)

The active matrix display device having the first arrangement, where: the potential of the liquid crystal driving voltage applied to the COM electrode is varied at a timing synchronizing with a timing at which the plurality of data signal lines are switched; and the COM potential outputted has a constant value when data signal lines for one color are driven.

(Fifth Arrangement)

The active matrix display device having the first arrangement, where: the potential of the liquid crystal driving voltage applied to the COM electrode is varied (i) at a timing synchronizing with a timing at which the plurality of data signal lines are switched and (ii) with use of a data line selection signal for simultaneously driving data signal lines corresponding to one color; and the COM potential outputted has a constant value when data signal lines for one color are driven.

(Sixth Arrangement)

The active matrix display device having the first arrangement, where: the potential of the liquid crystal driving voltage applied to the COM electrode is varied at a timing synchronizing with a timing at which the plurality of data signal lines are switched; and, for every horizontal period corresponding to one COM polarity, the COM potential outputted has a constant value when data signal lines for one color are driven.

(Seventh Arrangement)

The active matrix display device having the first arrangement, where: the potential of the liquid crystal driving voltage applied to the COM electrode is varied (i) at a timing in synchronization with a timing at which the plurality of data signal lines are switched and (ii) with use of a data line selection signal for simultaneously driving data signal lines corresponding to one color; and, for every horizontal period corresponding to one COM polarity, the COM potential outputted has a constant value when data signal lines for one color are driven.

(Eighth Arrangement)

The active matrix display device having the sixth arrangement, where (i) a difference between a COM center potential and a positive COM potential applied to liquid crystal for displaying desired color data is equal to (ii) a difference between the COM center potential and a negative COM potential applied to the liquid crystal for displaying the above color data.

(Ninth Arrangement)

The active matrix display device having the seventh arrangement, where (i) a difference between a COM center potential and a positive COM potential applied to liquid crystal for displaying desired color data is equal to (ii) a difference between the COM center potential and a negative COM potential applied to the liquid crystal for displaying the above color data.

The present invention is not limited to the description of the embodiment above, but may be altered by a skilled person within the scope of the claims. Any embodiment based on a combination of technical means properly modified within the scope of the claims is encompassed in the technical scope of the present invention.

Finally, each block, especially the counter electrode control section 10, included in the liquid crystal display device may be realized by way of hardware or software as executed by a CPU as follows.

The liquid crystal display device includes a CPU (central processing unit) and memory devices (storage media). The CPU (central processing unit) executes instructions in control programs realizing the functions. The memory devices include a ROM (read only memory) which contains programs, a RAM (random access memory) to which the programs are loaded, and a memory containing the programs and various data. The object of the present invention can also be achieved by mounting to the liquid crystal display device a computer-readable storage medium containing control program code (executable program, intermediate code program, or source program) for the liquid crystal display device, which program is software realizing the aforementioned functions, in order for the computer (or CPU, MPU) to retrieve and execute the program code contained in the storage medium.

The storage medium may be, for example: a tape such as a magnetic tape or a cassette tape; a magnetic disk such as a Floppy (Registered Trademark) disk or a hard disk, or an optical disk such as CD-ROM/MO/MD/DVD/CD-R; a card such as an IC card (memory card) or an optical card; or a semiconductor memory such as a mask ROM/EPROM/EEPROM/flash ROM.

The liquid crystal display device may be arranged to be connectable to a communications network so that the program code may be delivered over the communications network. The communications network is not limited in any particular manner, and may be, for example, the Internet, an intranet, extranet, LAN, ISDN, VAN, CATV communications network, virtual dedicated network (virtual private network), telephone line network, mobile communications network, or satellite communications network. The transfer medium which makes up the communications network is not limited in any particular manner, and may be, for example: a wired line such as IEEE 1394, USB, electric power line, cable TV line, telephone line, or ADSL line; or wireless such as infrared radiation (IrDA, remote control), Bluetooth (Registered Trademark), 802.11 wireless, HDR, mobile telephone network, satellite line, or terrestrial digital network. The present invention encompasses a computer data signal embedded in a carrier wave in which the program code is embodied electronically.

According to the liquid crystal display device of the present invention, and to the method and the circuit of the present invention for driving the liquid crystal display device, the liquid crystal display device includes: a plurality of data signal lines; a plurality of scanning signal lines intersecting orthogonally with the plurality of data signal lines; pixel electrodes each provided at each of intersections of the plurality of data signal lines and the plurality of scanning signal lines; and a counter electrode provided so as to face the pixel electrodes, the plurality of data signal lines divided into sets each including data signal lines that are provided next to one another so as to respectively correspond to primary colors constituting a display color, the sets each being connected to a data signal output line to which data signals each corresponding to one of the primary colors are supplied during a single horizontal scanning period by time division, the plurality of data signal lines, each corresponding to one of the primary colors, being sequentially selected so that data signal lines corresponding to one of the primary colors are selected at a time by a data line selection signal supplied in synchronization with a timing at which the data signals supplied to the data signal output line are switched, the counter electrode being subjected to application of a voltage being variable during at least one horizontal scanning period.

The embodiment and concrete examples of implementation discussed in the foregoing detailed explanation serve solely to illustrate the technical details of the present invention, which should not be narrowly interpreted within the limits of such an embodiment and concrete examples, but rather may be applied in many variations within the spirit of the present invention, provided such variations do not exceed the scope of the patent claims set forth below.

INDUSTRIAL APPLICABILITY

The liquid crystal display device of the present invention is applicable to products each including a liquid crystal display. In particular, the liquid crystal display device of the present invention is suitably applicable to liquid crystal displays of, e.g., televisions and mobile telephones.

The invention claimed is:

1. A liquid crystal display device comprising:

a plurality of data signal lines;

a plurality of scanning signal lines intersecting orthogonally with the plurality of data signal lines;

pixel electrodes each provided at each of intersections of the plurality of data signal lines and the plurality of scanning signal lines; and a counter electrode provided so as to face the pixel electrodes, the plurality of data signal lines divided into sets each including data signal lines that are provided next to one another so as to respectively correspond to primary colors constituting a display color, the sets each being connected to a data signal output line to which data signals each corresponding to one of the primary colors are supplied during a single horizontal scanning period by time division, the plurality of data signal lines, each corresponding to one of the primary colors, being sequentially selected so that data signal lines corresponding to one of the primary colors are selected at a time by a data line selection signal supplied in synchronization with a timing at which the data signals supplied to the data signal output line are switched, for each of the plurality of data signal lines sequentially selected, the counter electrode being subjected to application of a voltage being variable during at least one horizontal scanning period in correspondence with a luminance of the primary color corresponding to the selected data signal lines, wherein the voltage applied to the counter electrode has polarities reversed from each other during two sequential horizontal scanning periods, in a case where the primary colors corresponding to selected ones of the plurality of data signal lines are same for horizontal scanning periods corresponding to an identical polarity, the voltage applied to the counter electrode is identical, and in a case where the primary colors corresponding to the selected ones of the plurality of data signal lines are same between any two horizontal scanning periods corresponding to the polarities different from each other, an absolute value of a difference between a center voltage and a positive voltage applied to the counter electrode is equal to an absolute value of a difference between the center voltage and a negative voltage applied to the counter electrode.

2. The liquid crystal display device according to claim 1, wherein the voltage applied to the counter electrode is varied in synchronization with the timing.

3. The liquid crystal display device according to claim 1, wherein the voltage applied to the counter electrode is varied by using the data line selection signal.

4. The liquid crystal display device according to claim 1, wherein, in a case where the primary colors corresponding to selected ones of the plurality of data signal lines are same for different horizontal scanning periods, the voltage applied to the counter electrode is identical.

5. A method for driving a liquid crystal display device, the liquid crystal display device including:

a plurality of data signal lines;

a plurality of scanning signal lines intersecting orthogonally with the plurality of data signal lines;

pixel electrodes each provided at each of intersections of the plurality of data signal lines and the plurality of scanning signal lines; and a counter electrode provided so as to face the pixel electrodes, the plurality of data signal lines divided into sets each including data signal lines that are provided next to one another so as to respectively correspond to primary colors constituting a display color, the data signal lines in each of the sets being sequentially selected during a single horizontal scanning period, the method comprising the step of:

varying a voltage, applied to the counter electrode, during the single horizontal scanning period in correspondence with a luminance of the primary color corresponding to the selected data signal lines, wherein the voltage applied to the counter electrode has polarities reversed from each other during two sequential horizontal scanning periods, in a case where the primary colors corresponding to selected ones of the plurality of data signal lines are same for horizontal scanning periods corresponding to an identical polarity, the voltage applied to the counter electrode is identical, and in a case where the primary colors corresponding to the selected ones of the plurality of data signal lines are same between any two horizontal scanning periods corresponding to the polarities different from each other, an absolute value of a difference between a center voltage and a positive voltage applied to the counter electrode is equal to an absolute value of a difference between the center voltage and a negative voltage applied to the counter electrode.

6. A circuit for driving a liquid crystal display device, the liquid crystal display device including:

a plurality of data signal lines;

a plurality of scanning signal lines intersecting orthogonally with the plurality of data signal lines;

pixel electrodes each provided at each of intersections of the plurality of data signal lines and the plurality of scanning signal lines; and a counter electrode provided so as to face the pixel electrodes, the plurality of data signal lines divided into sets each including data signal lines that are provided next to one another so as to respectively correspond to primary colors constituting a display color, the sets each being connected to a data signal output line to which data signals each corresponding to one of the primary colors are supplied during a single horizontal scanning period by time division, the plurality of data signal lines, each corresponding to one of the primary colors, being sequentially selected so that data signal lines corresponding to one of the primary colors are selected at a time by a data line selection signal supplied in synchronization with a timing at which the data signals supplied to the data signal output line are switched, the circuit varying a voltage, applied to the counter electrode, during at least one horizontal scanning period, in synchronization with the timing and in correspondence with a luminance of the primary color corresponding to the selected data signal lines, the circuit varying the voltage in response to the data line selection signal, wherein the voltage applied to the counter electrode has polarities reversed from each other during two sequential horizontal scanning periods, in a case where the primary colors corresponding to selected ones of the plurality of data signal lines are same for horizontal scanning periods corresponding to an identical polarity, the voltage applied to the counter electrode is identical, and in a case where the primary colors corresponding to the selected ones of the plurality of data signal lines are same between any two horizontal scanning periods corresponding to the polarities different from each other, an absolute value of a difference between a center voltage and a positive voltage applied to the counter electrode is equal to an absolute value of a difference between the center voltage and a negative voltage applied to the counter electrode.

* * * * *